United States Patent [19]

Hagenbucher

[11] 4,129,938

[45] Dec. 19, 1978

[54] METHOD OF MAKING TUBULAR COILS WITH COOLING AND INSULATING CHANNELS

[76] Inventor: Hariolf Hagenbucher, Zimmersmühlenweg 10/11, D-637 Oberursel, Fed. Rep. of Germany

[21] Appl. No.: 729,708

[22] Filed: Oct. 5, 1976

Related U.S. Application Data

[63] Continuation-in-part of Ser. No. 607,426, Aug. 25, 1975, abandoned, which is a continuation of Ser. No. 407,189, Oct. 17, 1973, abandoned.

[51] Int. Cl.[2] ..... H01F 41/06

[52] U.S. Cl. ..... 29/605; 156/173; 336/60; 36/96; 336/205

[58] Field of Search ..... 29/602, 605; 156/173, 156/184, 242; 336/60, 205, 96; 264/272, 257

[56] References Cited

U.S. PATENT DOCUMENTS

| | | | |
|---|---|---|---|
| 3,201,728 | 8/1965 | McWhirter | 336/60 |
| 3,548,355 | 12/1970 | Martincic et al. | 336/60 |
| 3,611,226 | 10/1971 | Cotton | 336/60 |
| 3,662,461 | 5/1972 | Lake et al. | 336/205 X |
| 3,711,807 | 1/1973 | Yamashita et al. | 336/205 |

FOREIGN PATENT DOCUMENTS

| | | | |
|---|---|---|---|
| 1270167 | 6/1968 | Fed. Rep. of Germany | 336/60 |
| 1980288 | 7/1968 | Fed. Rep. of Germany | 336/60 |
| 1763515 | 12/1971 | Fed. Rep. of Germany | 336/60 |
| 2117204 | 10/1972 | Fed. Rep. of Germany | 336/60 |

*Primary Examiner*—Carl E. Hall
*Attorney, Agent, or Firm*—Oliver D. Olson

[57] ABSTRACT

A dry insulated, impulse voltage resistant, multi-layer series wound coil having air ducts between layers for use in transformers, reactors, and the like is made with minimum solid insulation spacing between adjacent conductors and maximum air spacing radially between coil layers. The method of making includes winding on a form of alternate layers of insulation and conductors. After one layer of winding is complete, cloth-wrapped duct-forming molds are supported on the windings and further insulation and conductors are wound around the whole assembly. When the desired number of layers is complete, the assembly is vacuum cast in a resin and the forms and the molds are then removed.

2 Claims, 12 Drawing Figures

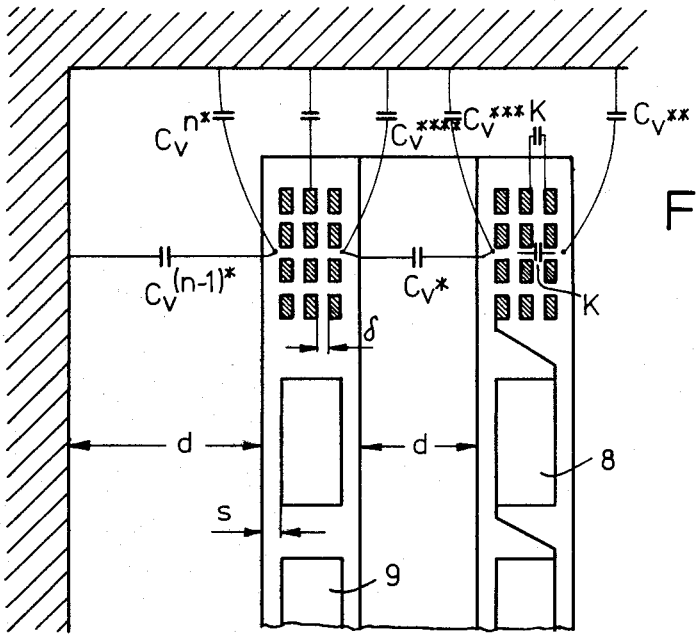
Fig. 3
Fig. 4
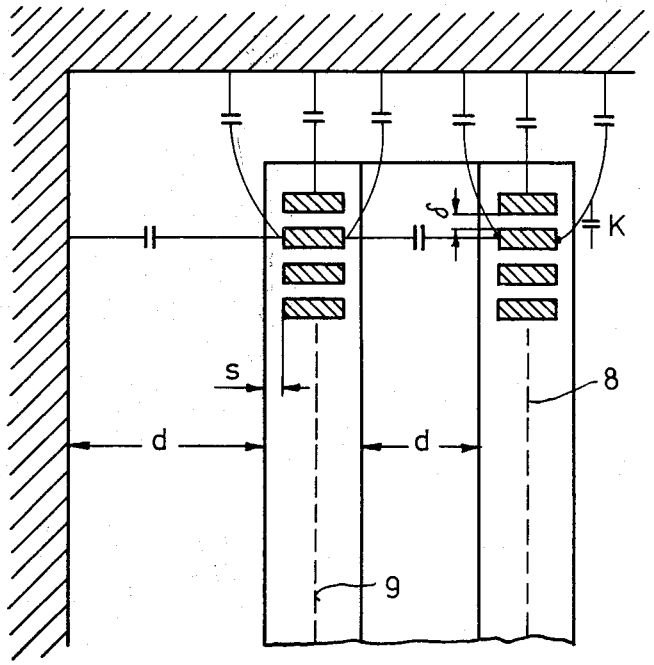

METHOD OF MAKING TUBULAR COILS WITH COOLING AND INSULATING CHANNELS

BACKGROUND OF THE INVENTION AND CROSS REFERENCE TO RELATED ART

This application is a continuation-in-part of my earlier application, Ser. No. 607,426, filed Aug. 25, 1975 which was a continuation of my still earlier application, Ser. No. 407,189, filed Oct. 17, 1973, both of which earlier applications are now abandoned.

Distribution transformers according to prevailing industry standards must be adapted for direct connection to the overhead lines of an electrical distribution system and with such connection they are apt to be subjected to high impulse voltages or other over voltages due to lightning storms or other atmospheric conditions. At the present time, according to prevailing industry standards, specifications are in existence only for oil or Ascarel filled transformers for this service. The reason for this is that up to now no one has devised a dry insulation transformer capable of withstanding high impulse voltages with an amplitude level comparable to that of oil or Ascarel filled transformers for the same use.

There are, however, situations where it would be desirable to use a dry insulated transformer in place of one with oil or Ascarel insulation.

At the present time there are known methods of manufacturing dry type tubular coils for transformers, reactors, or other inductive appliances having two or more winding layers with air ducts therebetween. One method of making such a product is described in DT-OS 2117204 - Pfeiffer. This describes the assembling of a cast resin coil using double-wound single coils, the terminals of which are led out of the whole coil to be connected exteriorly. These single coils have two layers with an air duct arranged in between to function solely as a cooling means for the coils. Coils constructed in this manner are generally not particularly resistant to impulse voltages because a flash-over can appear outside the coil between the connecting terminals of the single coils.

It is also known to place thermally and electrically conducting metallic tubes between two radially spaced layers of a cast resin coil. Here again, these tubes have as their only function to cool the coil and they remain in place after the casting process (DT Gbm 1980288). Such tubes are grounded and therefore all of the electrical stress is shifted into the solid insulation which has to absorb all the voltage so that such metallic ducts play no role in the electrical strength of the coil.

Still another known winding arrangement is one where the individual layers of the coil with air ducts therebetween are connected by bridges. This special "meander" winding must of necessity have three layers and the air ducts between serve only a cooling function (DT AS 1270167).

Accordingly, it is the principal object of the present invention to provide dry insulated coils useful in distribution and Power transformers which can withstand the same or only a slightly reduced impulse voltage level as equivalent oil or Ascarel insulated transformers and to a method of making such coils.

BRIEF DESCRIPTION OF THE DRAWINGS

FIG. 3 is a schematic representation with equivalent circuit plan showing the capacitances and spacings of the coils for a single coil winding in accordance with the present invention;

FIG. 4 is a view similar to FIG. 3 but showing an edgewise or flat wound coil;

DETAILED DESCRIPTION

Figure 1:
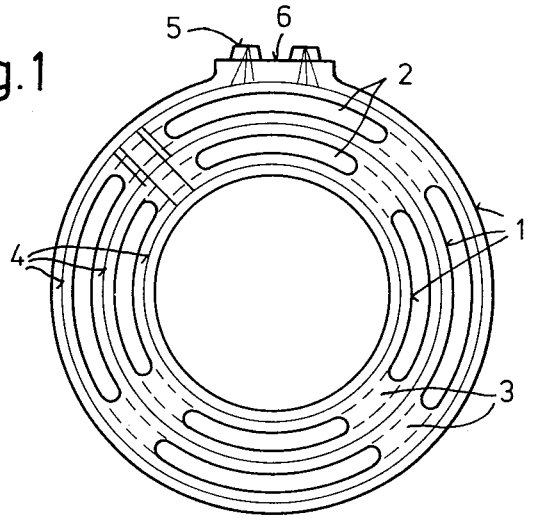
FIG. 1 is a schematic showing of a section perpendicular to the axis of a tubular coil in accordance with the present invention.
Figure 2:
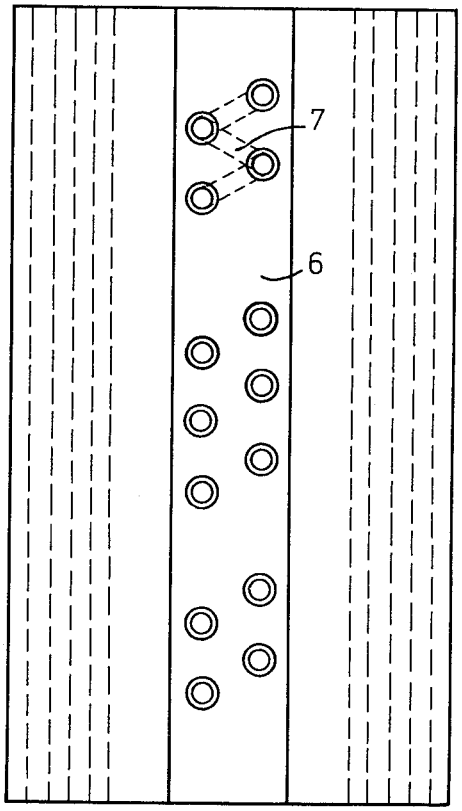
FIG. 2 is a side elevation of the tubular coil of FIG. 1.

Referring first to FIGS. 1 and 2, these show a finished high voltage coil made in accordance with the present invention as a tubular coil having three main winding layers with air ducts partially filling the radial spacing between the three layers of the coil. The ducts are identified by the reference numeral 2 and the three winding layers by the reference numeral 4. The circumferential space between adjacent air ducts in the same layer is filled with a cast dielectric resin as will be explained hereinafter. These bridge portions are identified by the numeral 3 in FIG. 1.

The ends of the winding or portions of the winding or taps are brought out and terminate in truncated cones 5 set in a connection plate 6 formed during the casting process as will be described hereinafter. By having the various ends or taps brought to a common area such as the connection plate 6, it becomes a simple matter to form the desired voltage changing connections by means of links 7 as indicated in FIG. 2.

Figure 5:
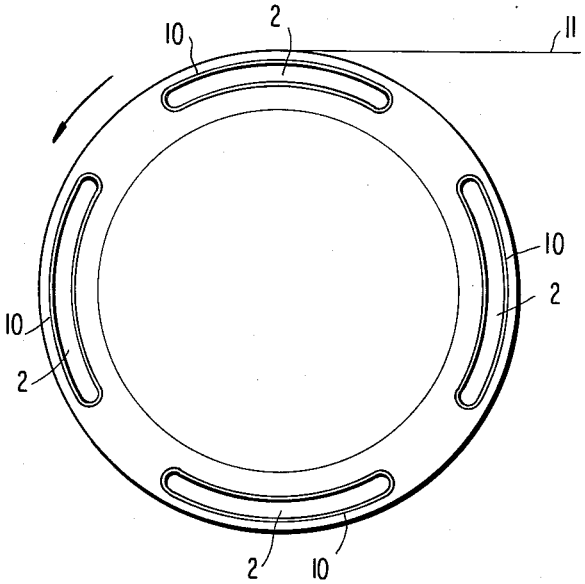
FIG. 5 is a diagrammatic end view of a coil in the process of being wound.
Figure 6:
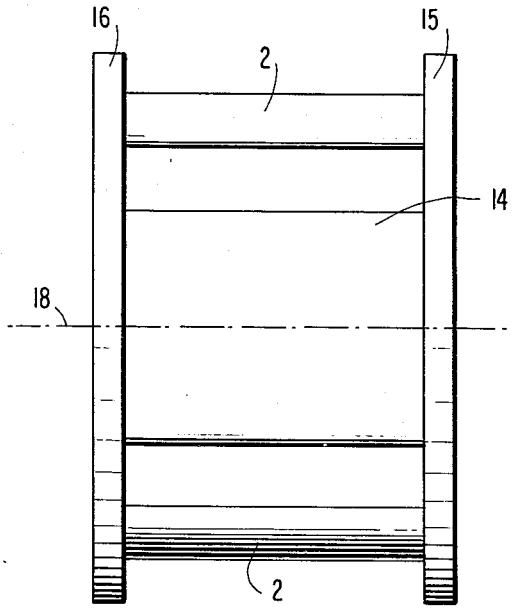
FIG. 6 is a view at 90° to that of FIG. 5 showing the means for supporting the duct molds during the winding process.

Referring now to FIGS. 5 and 6, the method of constructing a coil in accordance with the present invention will be described. A smooth hollow cylindrical core member 14 is mounted for rotation by any appropriate driving means. A tissue-like filler material such as synthetic cotton, glass fiber or fleece is first wound on the form 14. The metallic conductors are then wound on top of this tissue-like filler material. Following each layer of conductors, a further layer of tissue-like filler material is wound and this sequence is repeated until the desired number of layers exist. Following a last layer of conductors, a further insulating layer is wound and then the molds for forming the duct work are placed on the exterior of the windings and held in place by means of a pair of disks 15 and 16 as indicated in FIG. 6. The molds are equi-circumferentially spaced from each other as indicated in FIG. 5. These are smooth, preferably hollow, metallic members which, in cross section, are segments of a torus with the segments provided with rounded ends as indicated in FIG. 5. Before being placed on the windings, they are first wrapped with cloth. The winding of the conductors then proceeds by winding on top of the thus assembled duct forming molds and inner layer of windings with the same repetitive interposition of tissue-like filler material between successive conductive layers. The entire process is repeated, for example, until there are three spaced layers of series connected coils as shown in FIG. 1 with the duct forming molds occupying the radial space between adjacent winding layers. After making the necessary tap connections, the conductors are brought out to truncated cones 5 as indicated in FIGS. 1 and 2 and the coil is then ready for vacuum casting with a high quality, high dielectric constant resin. In the mold, the resin in liquid form saturates the tissue-like filler material and when cured forms a unitary cast laminate of high dielectric strength.

After the curing step, the molds are removed leaving the air ducts extending completely through the finished coil from one end to the other. The inner mold or mandrel on which the entire assembly was built up is also removed so that the finished product is merely a cylindrical cast resin laminate with the air ducts extending therethrough and completely enclosing the conductors which form the coils.

Referring now to FIGS. 3 and 4, the geometrical and dimensional factors which make the coils of this invention suitable for use in dry insulated transformers which can be substituted for oil filled or Ascarel filled transformers of the same or nearly the same impulse voltage strength will be described.

The present invention proceeds on the knowledge that the dielectric strength of air cannot be improved very much by homogenization of the electric field so the inventive concept involves a noticeable reduction of the stress by an appropriate arrangement of the windings and insulation so that the stress will be a minimum. The previously described assembly steps of a coil are carried out so that in the final form of the product, the distance between adjacent layers of a coil and between adjacent conductors in the same layer will be as small as possible. The preferred dimension is approximately 0.5 to 1.0 mm. This dimension is given in FIG. 3 as $\delta$. At the same time, the radial distance in air between two main layers of each coil or between a main layer and a low voltage coil or grounded parts is made as large as possible while maintaining a thickness of the insulation laminate between coil layers and the duct itself as small as possible. The distance identified by d in FIG. 3 is the air distance which is the radial dimension of any one of the ducts. Preferably, the distance d is about ten to twenty times the dimension of $\delta$. If $\delta$ is maintained between 0.5 and 1.0 mm, a relatively high capacitance K results because of the small distance $\delta$ and the high dielectric constant together with a very small value of the capacitance Ce because of the small dielectric constant in air and the relatively big distance d (K is the resulting series capacitance inside the main layers between single layers of FIG. 3 or between single turns of FIG. 4 and Ce is the resulting capacitance to ground).

By adhering to these dimensions, the ratio of $\sqrt{Ce/K}$ is as low in numerical value as possible, and this makes the windings almost non-oscillating under impulse test conditions. In a manner surprising to those expert in this art, by adhering to the aforedescribed dimensioning, a coil which has excellent resistance to impulse voltages results.

It is important to note that in complete contrast to the prior art, the ducts function not only to cool the windings but also to render them impulse voltage resistant. The latter function is due entirely to the geometry and dimensioning of the coils and insulation ducts.

Figure 7:
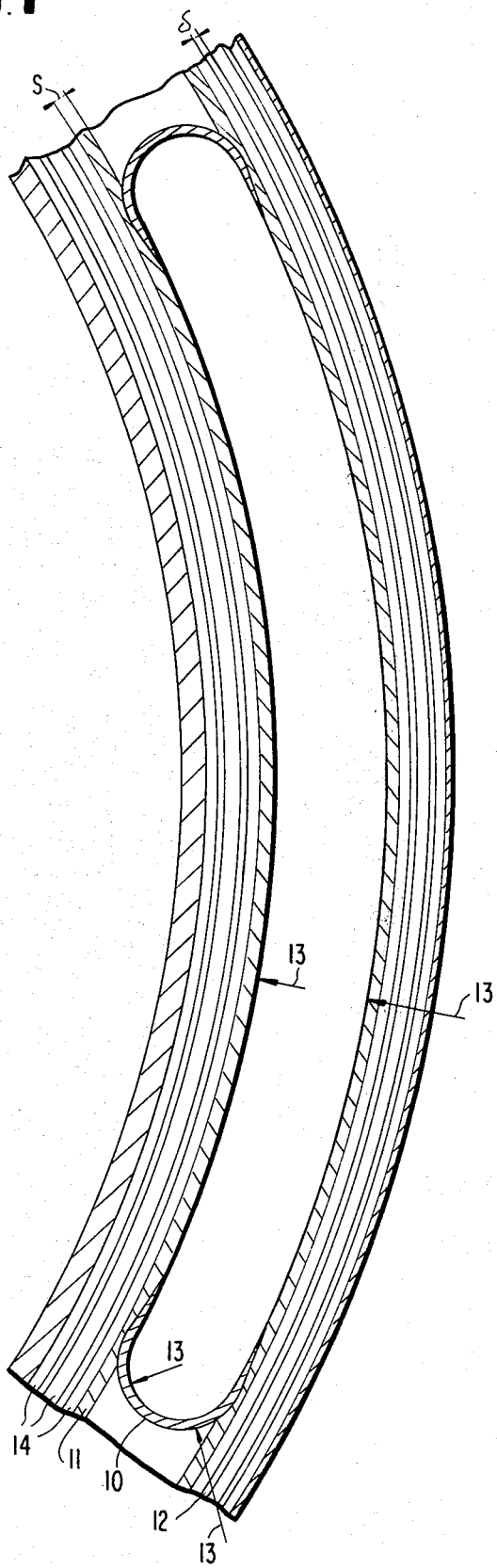
FIGS. 7 and 8 are horizontal sections through portions of completed coils and indicate the direction of the electrical field strength vectors.
Figure 8:
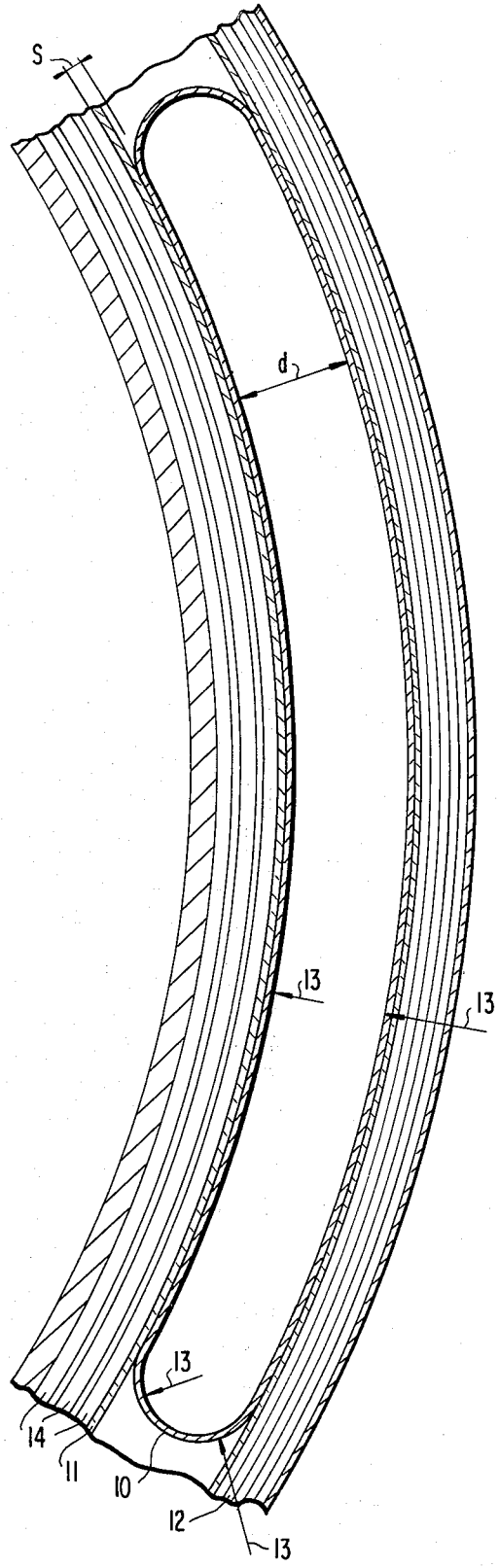

Referring now to FIGS. 7 and 8, these are horizontal partial sections through a finished coil. In FIG. 8, the reference numeral 10 identifies with textile material with which the air duct cores were wrapped prior to placing them in the winding assembly. Such textile layers become a part of the resin textile laminate formed during the vacuum casting process and they remain as an integral part of the finished structure after the cores have been withdrawn. The numeral 11 identifies the textile insulating material which during the winding process is wound onto all of the cores simultaneously. The insulation between successive layers of conductors is indicated at 12 with the conductors themselves identified by 14. Under voltage testing, the electrical field vectors will always be normal to the surface of the laminate as indicated by the vectors 13 in each of FIGS. 7 and 8.

Figure 9:
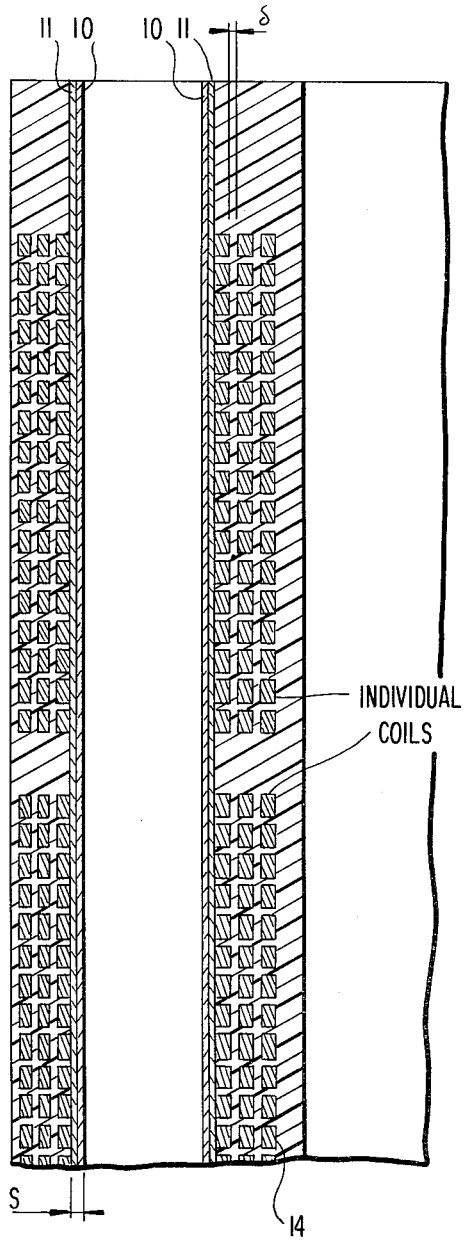
FIG. 9 is a vertical section showing two layers of coils with an air duct extending therebetween.

FIG. 9 is a partial vertical section through a finished coil showing the same elements which appear in FIGS. 7 and 8 and identified by the same reference numerals.

Figure 10:
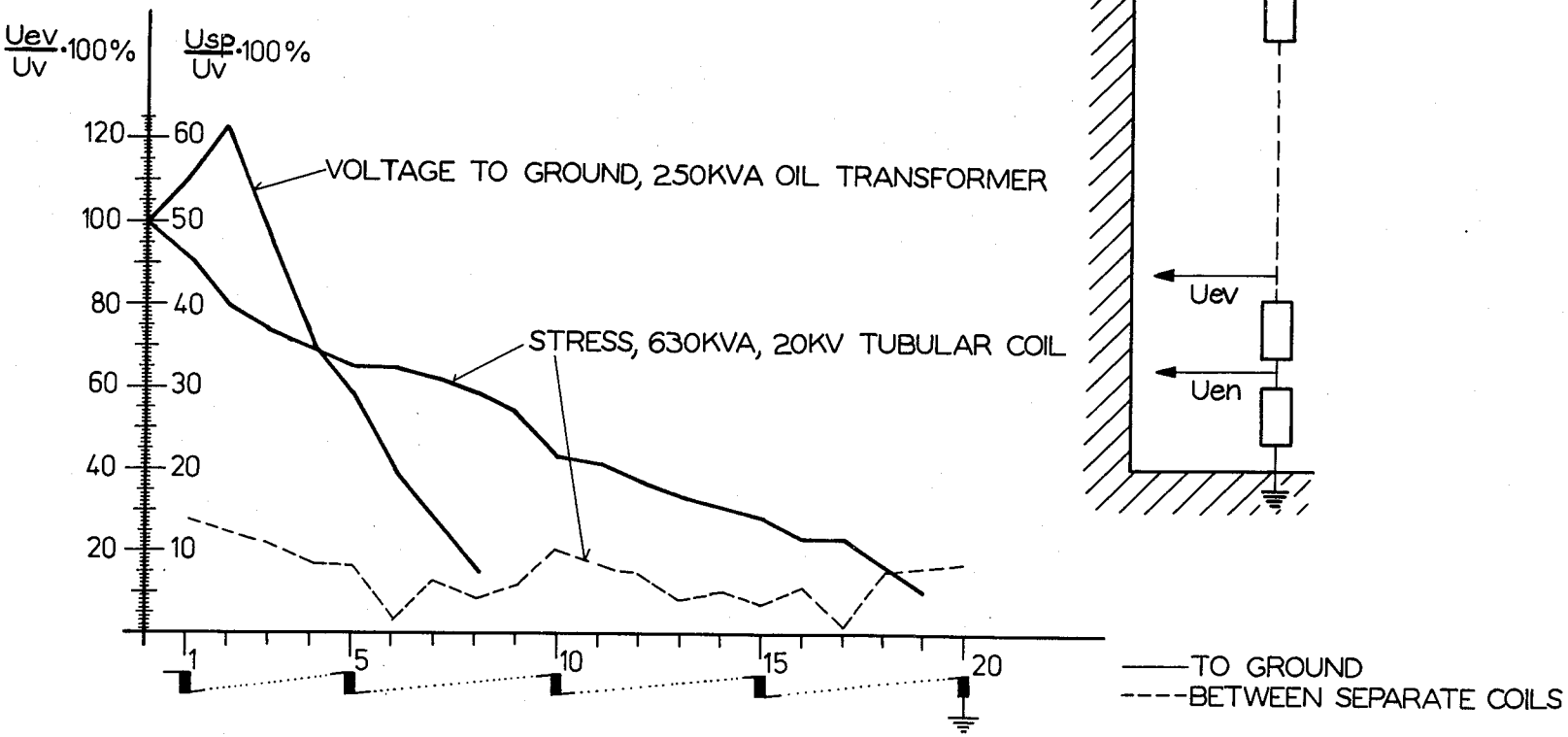
FIG. 10 is a voltage diagram comparing a coil of the present invention undergoing impulse testing with a comparable oil filled transformer.

In FIG. 10, a comparison is shown between impulse testing a tubular coil in accordance with the present invention and for a 250 KVA 20 KV oil filled transformer which contains 8 individual single coils. As shown in this figure, the electrical stress between any part of the windings of the tubular coil and ground is always less than the applied voltage when impulse testing and the maximum voltage drop on a single coil, identical with the stress between separate coils of the oil filled transformer, is only approximately 14 percent of the applied impulse voltage.

Figure 11:
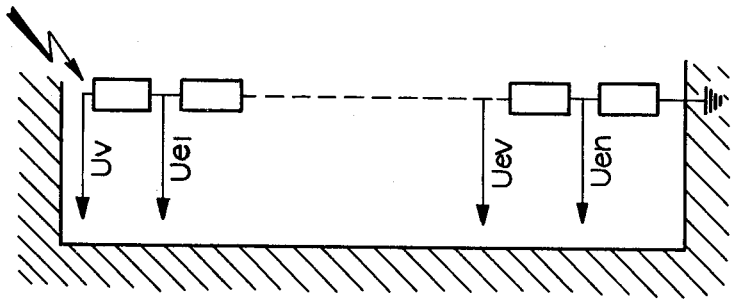
FIG. 11 is a schematic representation showing the tapped voltages of FIG. 10.

FIG. 11 shows the voltage vectors from any part of winding to ground Uev, the numerical value of which is shown in FIG. 10.

Figure 12:
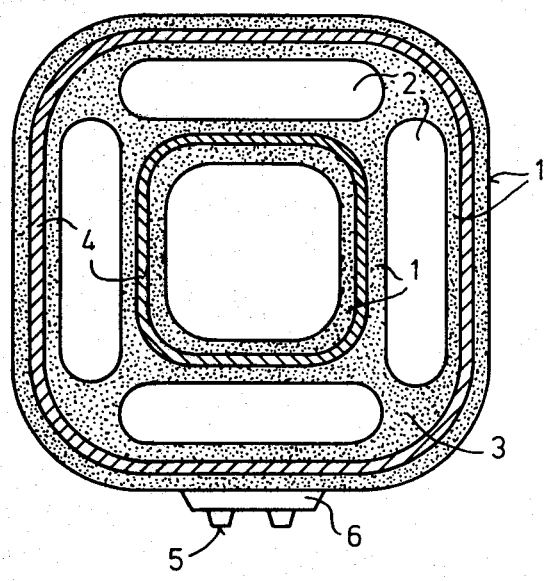
FIG. 12 is a view similar to FIG. 1 showing a modified version.

Referring lastly to FIG. 12 of the drawings, this merely shows a modified version of the coil shown in FIGS. 1 and 2 in which the coil is shaped rectangularly rather than circularly and has rounded edges. This permits some simplification of the shape of the molding cores and renders them less expensive to manufacture. In comparison with FIG. 5, the cores of FIG. 12 are considered to be segments of a torus of very large diameter, with the segments provided with rounded ends in the same manner as in FIG. 5. However, mechanical short-circuit resistance is not quite as high as for the circular coils of FIGS. 1 and 2. It is contemplated that the modification shown in this figure may have some advantage for smaller power ratings.

While preferred embodiments of the present invention have been herein shown and disclosed, Applicant claims the benefit of a full range of equivalents within the scope of the appended claims.

I claim:

1. A method of making a hollow dry insulated multilayer series-connected air-cooled coil, which is highly resistant to impulse voltages, the steps comprising:

a. on a form, winding a predetermined number of alternate layers of thin sheet insulation capable of absorbing liquid resin and turns of a single conductor;

b. supporting on the thus-wound layers, a plurality of elongated equi-circumferentially spaced duct forming cloth-wrapped molds each having a cross-section which is a section of a torus with the section having rounded ends;

c. continuing winding alternate layers of said thin sheet insulation and additional turns of said conductor around the assembly of molds and underlying layers of insulation and conductor;

d. repeating the foregoing steps until the desired number of layers and molds is complete;

e. vacuum casting the completed assembly with a high dielectric constant high quality resin to completely permeate the sheet insulation and cloth wrapping;

f. curing said resin to form a unitary laminate with said cloth and insulation; and g. removing said form and molds, the radial dimension of said ducts defining the radial air spacing between layers of the coil and being about ten to twenty times the solid insulation spacing between adjacent conductors in the same layer and the solid insulation between the coils and the adjacent duct which latter dimension is held to between 0.5 and 1.0 mm.

2. A method of making a hollow dry insulated multilayer series-connected air-cooled coil, which is highly resistant to impulse voltages, the steps comprising:

a. on a form, winding a predetermined number of alternate layers of thin sheet insulation capable of absorbing liquid resin and turns of a single conductor;

b. supporting on the thus-wound layers, a plurality of elongated equi-circumferentially spaced duct forming cloth-wrapped molds each having a cross-section which is a section of a torus with the section having rounded ends;

c. continuing winding alternate layers of thin sheet insulation and additional turns of said conductor around the assembly of molds and underlying layers of insulation and conductor;

d. repeating the foregoing steps until the desired number of layers and molds is complete;

e. vacuum casting the completed assembly with a high dielectric constant high quality resin to completely permeate the sheet insulation and cloth wrapping;

f. curing said resin to form a unitary laminate with said cloth and insulation; and g. removing said form and molds, the radial dimension of said ducts defining the radial air spacing between layers of the coil of a few millimeters and the solid insulation between the coils and the adjacent duct is between 0.5 and 1.0 mm.

* * * * *